United States Patent [19]

Schaub et al.

[11] Patent Number: 4,848,739

[45] Date of Patent: Jul. 18, 1989

[54] HYDRAULIC EXERCISE MACHINE

[76] Inventors: Mark J. Schaub, 604 Hawthorne St., Albert Lea, Minn. 56007; John R. Engen, R.R. 1, Box 7, Clarks Grove, Minn. 56016

[21] Appl. No.: 151,505

[22] Filed: Feb. 2, 1988

[51] Int. Cl.[4] ..... A63B 21/00

[52] U.S. Cl. ..... 272/134; 272/130

[58] Field of Search ..... 272/130, 134, 144, DIG. 4, 272/136, 142

[56] References Cited

U.S. PATENT DOCUMENTS

| | | | |
|---|---|---|---|
| D. 242,732 | 12/1976 | Brentham | 272/130 X |
| 3,128,094 | 4/1964 | Wolf | 272/130 |
| 3,369,403 | 2/1968 | Carlin | 272/130 |
| 3,638,941 | 2/1972 | Kulkens | 272/130 X |
| 3,822,599 | 7/1974 | Brentham | 272/130 X |
| 4,072,309 | 2/1978 | Wilson | 272/144 X |
| 4,183,520 | 1/1980 | Chase | 272/130 |
| 4,226,415 | 10/1980 | Wright | 272/130 |
| 4,241,913 | 12/1980 | Zwayer | 272/130 |
| 4,275,882 | 6/1981 | Grosser | 272/130 X |
| 4,337,050 | 6/1982 | Engalitcheff, Jr. | 272/132 X |
| 4,357,010 | 11/1982 | Telle | 272/130 X |
| 4,358,109 | 11/1982 | Schrems | 272/134 X |
| 4,397,462 | 8/1983 | Wilmarth | 272/130 |
| 4,448,412 | 5/1984 | Brentham | 272/130 |
| 4,465,274 | 8/1984 | Davenport | 272/130 |
| 4,546,967 | 10/1985 | Kecala | 272/144 X |
| 4,576,377 | 3/1986 | Wolff | 272/134 X |
| 4,618,144 | 10/1986 | Gibson | 272/134 |
| 4,667,955 | 5/1987 | Giesch | 272/130 |
| 4,726,583 | 2/1988 | Olsen et al. | 272/130 |

FOREIGN PATENT DOCUMENTS

| | | | |
|---|---|---|---|
| 0135346 | 3/1985 | European Pat. Off. | 272/130 |
| 2146910 | 5/1985 | United Kingdom | 272/130 |

*Primary Examiner*—Richard J. Apley
*Assistant Examiner*—Robert W. Bahr
*Attorney, Agent, or Firm*—Fleit, Jacobson, Cohn, Price, Holman & Stern

[57] ABSTRACT

A hydraulic exercise device including an elongated base having first and second ends and a standard projecting upwardly from the first end of the base having a first end of a horizontal bench pivotally supported therefrom for oscillation about a horizontal transverse axis. The second end of the bench is disposed over the second end of the base and supported therefrom by generally vertical legs including upper and lower portions pivotally anchored to the bench and base, respectively. A lever has one thereof pivotally supported from the standard above the first end of the bench and the second end of the lever projects toward the second end of the base. A double acting hydraulic cylinder has one end connected to the second end of the lever and the other end connected to the standard at a point spaced vertically therealong from the first end of the lever. The upper end of the standard includes a hydraulic oil tank and the opposite ends of the cylinder include inlet and outlet fittings communicated with corresponding inlet and outlet fittings of the tank having adjustable flow control valves operatively associated therewith.

4 Claims, 2 Drawing Sheets

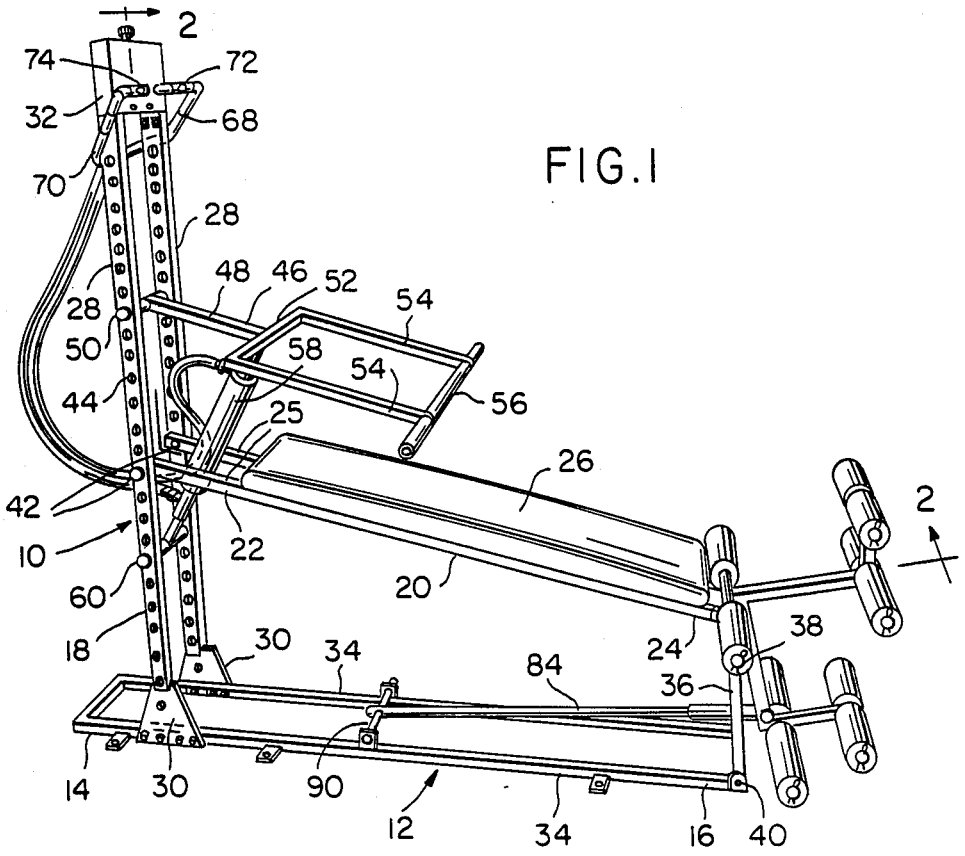
FIG. 1
FIG. 3
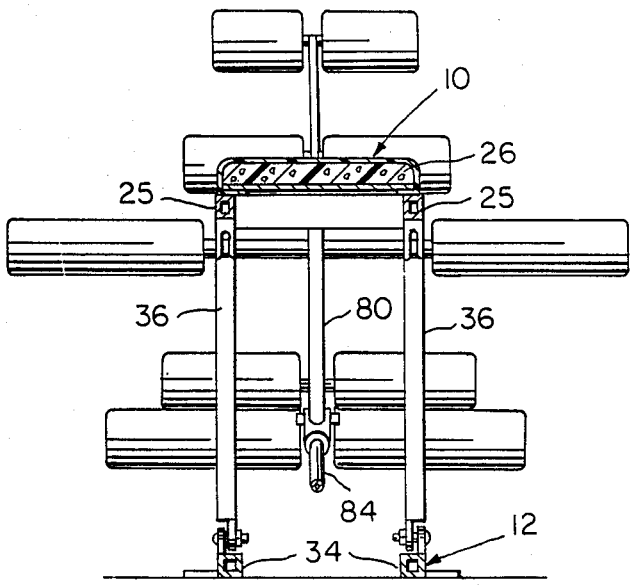
FIG. 5
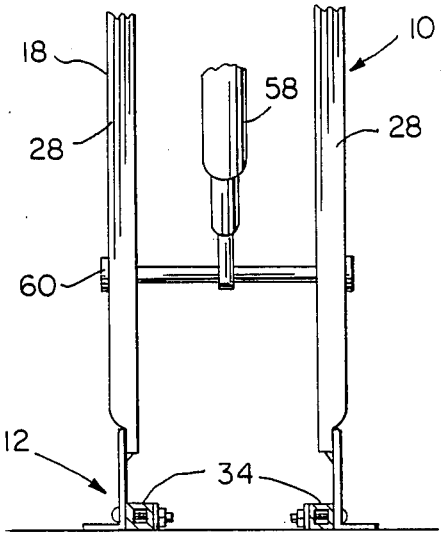

HYDRAULIC EXERCISE MACHINE

BACKGROUND OF THE INVENTION

1. Field of the Invention

This invention relates to an exercise apparatus which may be used in a prone position, or a sitting position, and which may be adjusted to enable exercising of various different upper torso muscles as well as leg muscles.

2. Description of Related Art

Various different forms of exercise apparatuses heretofore have been provided for exercising both upper torso and leg muscles and also apparatuses which may be used in both the sitting and prone positions. However, most of these previously known devices have not been specifically designed to provide extreme variation in the resistance afforded movement of a movable exercising portion of the exerciser nor have they been constructed in a manner to enable variable proportional resistance to movement of a movable portion of the exerciser throughout the limits of movement thereof.

Examples of exercising devices including some of the general structural and operational features of the instant invention are disclosed in U.S. Pat. Nos. 3,128,094, 3,369,403, 3,638,941, 3,822,599, 4,226,415, 4,275,882, 4,241,913, 4,357,010 and 4,465,274 as well as U.S. Design Pat. 242,732.

SUMMARY OF THE INVENTION

The exercising apparatus of the instant invention includes a horizontally elongated base upwardly from one end of which a standard projects and over which a bench is disposed in vertically spaced relation relative to the base. The bench extends longitudinally of the base and the head end of the bench and the standard include structure anchoring the bench head end to the standard in adjusted vertically spaced positions therealong. The foot end of the bench is supported from the end of the base remote from the standard through the utilization of depending leg structure whose upper and lower ends are pivotally anchored to the bench and the base, respectively. In addition, a force lever having first and second ends is provided and the first end of the lever and the standard include co-acting structure pivotally supporting the first end of the lever from the standard for oscillation of the lever relative to the standard in a vertical plane and with the second end of the lever disposed over the bench. Also, the first end of the lever is adjustable along the standard and movement resisting structure is operatively connected between the second end of the lever and the standard to variably resist angular displacement of the lever relative to the standard.

The main object of this invention is to provide an exercising apparatus including a unique combination of adjustable features thereof whereby various different upper torso and arm exercises may be accomplished with a varying degree of resistance being offered by the exercising apparatus.

Another object of this invention is to provide an exercise apparatus which may be adjusted to generate certain resistance to arm and upper torso movements throughout different positions of upper torso and arm movements.

Yet another object of this invention is to provide an exercising apparatus including means for resisting movement of a movable portion of the exercise apparatus in a manner such that either the initial movement of the movable portion or the final movement of the movable portion through a given cycle of movement thereof may be reduced or increased, as desired.

Yet another object of this invention is to provide an exercising apparatus which also may be used effectively for leg exercises.

A final object of this invention to be specifically enumerated herein is to provide an exercising apparatus in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the exercising apparatus;

FIG. 3 is a transverse vertical sectional view taken substantially upon the plane indicated by the sectional line 3—3 of FIG. 2;

FIG. 5 is a fragmentary enlarged transverse vertical sectional view taken substantially upon the plane indicated by the section line 5—5 of FIG. 2.

DESCRIPTION OF THE PREFERRED EMBODIMENT

Figure 4:
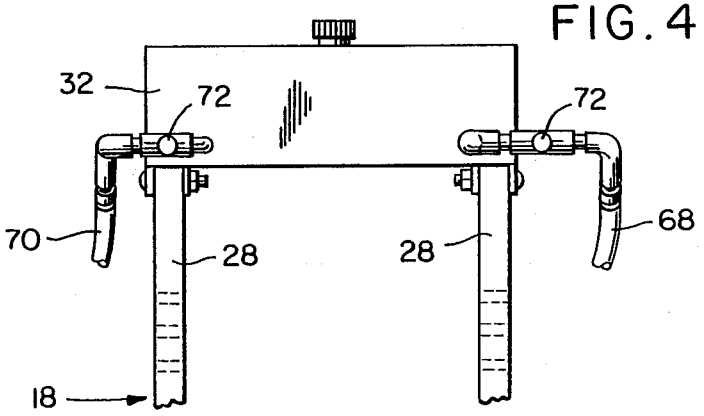
FIG. 4 is a fragmentary elevational view of the upper portion of the standard of the exercise apparatus illustrating the manner in which the hydraulic oil supply tank is mounted from the upper end of the standard portion.

Referring now more specifically to the drawings the numeral 10 generally designates the exercise machine of the instant invention. The machine 10 includes a horizontally elongated base 12 including first and second ends 14 and 16 and an upright standard 18 supported from the first end 14. In addition, machine 10 includes a generally horizontal bench 20 including first and second ends 22 and 24. The bench 20 extends longitudinally of and is vertically superposed over the base 12 in spaced relation relative thereto. The bench 20 is composed of a pair of opposite side longitudinal frame members 25 interconnected by a cushion construction 26 secured thereover. The standard 18 includes a pair of opposite side uprights 28 whose lower ends are mounted to the first end 14 of the base 12 as at 30 and the upper ends of the uprights are interconnected by a hydraulic oil reserve tank 32 supported therefrom.

The base 12 includes opposite side longitudinal members 34 and the lower ends of the uprights 28 are anchored to the corresponding longitudinal members 34. In addition, the ends of the frame members 25 at the second end 24 of the bench 20 are pivotally connected to the upper ends of a pair of depending legs 36 by a removable transverse shaft 38 and the lower ends of the legs 36 are pivotally anchored to the longitudinal members 34 at the second end 16 of the base 12 as at 40. Further, the ends of the frame members 25 at the first end 22 of the bench 20 are pivotally anchored to the uprights 28 by removable pins 42 received through a selected pair of horizontally registered apertures 44 formed in and spaced vertically along the uprights 28.

An elongated lever 46 has one end 48 thereof pivotally anchored between the uprights 28 by a removable pin 50, the pin 50 also being receivable through a horizontally registered pair of the aperatures 44.

The second end 52 of the lever 46 is Y-shaped and includes a pair of parallel arms 54 between whose free ends a hand grip bar 56 is secured.

Figure 2:
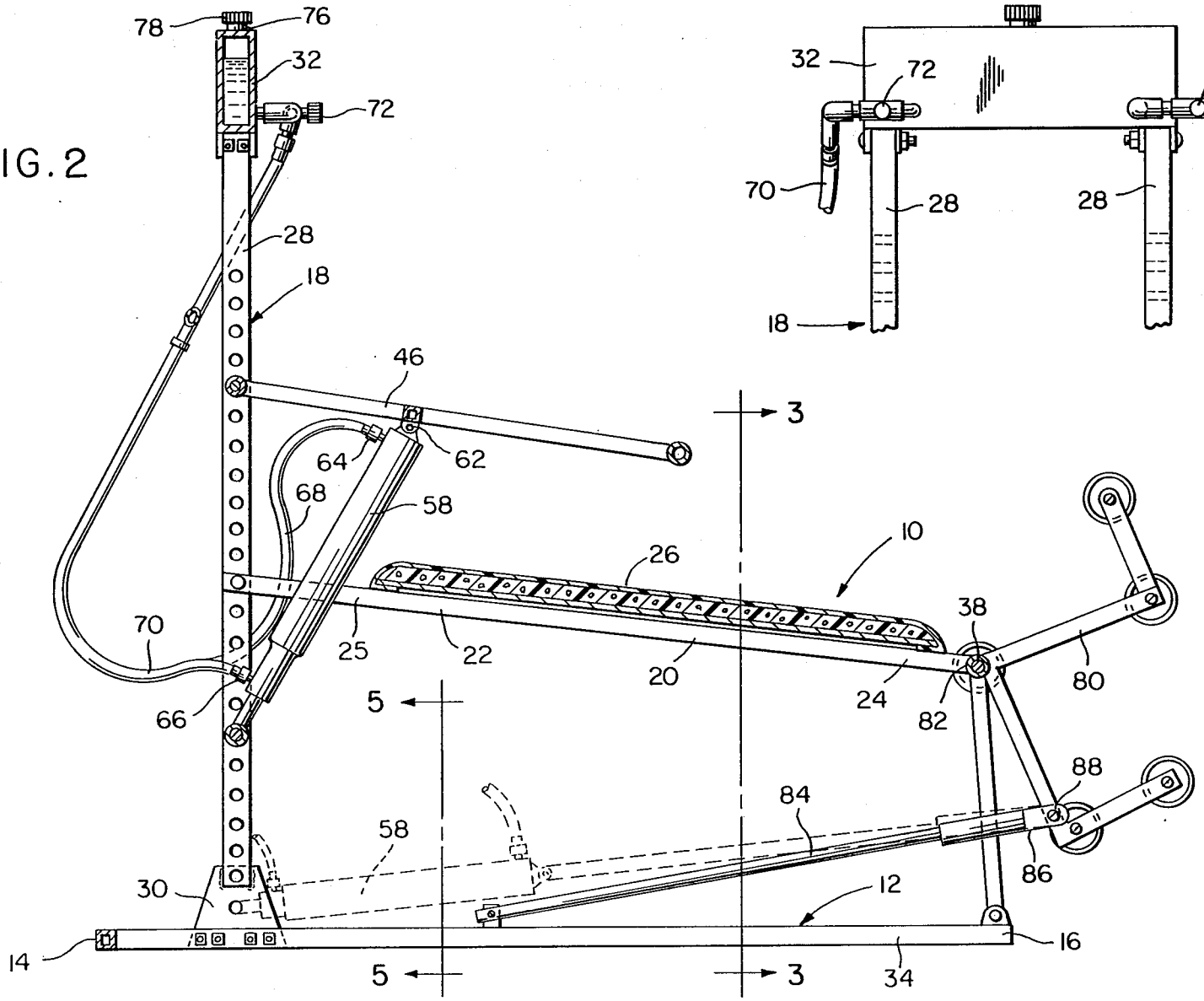
FIG. 2 is an enlarged longitudinal vertical sectional view taken substantially upon the plane indicated by the section line 2—2 of FIG. 1.

One end of a double acting hydraulic cylinder 58 is mounted between the uprights 28 by a removable pin 60 receivable through a selected pair of horizontally registered apertures 44 and the other end of the hydraulic cylinder 58 is removably pivotally anchored to the lever 46 as at 62, see FIG. 2.

The hydraulic cylinder 58 includes a pair of opposite end combined inlet and outlet fittings 64 and 66 to which corresponding ends of a pair of flexible hydraulic lines 68 and 70 are connected and the other ends of the lines 68 and 70 open into the interior of the tank 32 and have variable flow controlling valves 72 and 74 serially connected therein whereby passage of hydraulic fluid through the lines 68 and 70 may be adjustably throttled, the tank 32 including a fill neck 76 provided with a removable closure 78.

The shaft 38 also pivotally mounts an L-shaped leg exerciser frame 80 from the second end 24 of the bench 20, the frame 80 including a sleeve portion 82 rotatable on the mid-portion of the shaft 38. Also, an elongated thrust member 84 has one end 86 pivotally anchored to the lower end of the frame 80 as at 88 and the other end of the thrust member 84 is removably anchored in an inactive position by a transverse anchor pin 90 whose opposite ends are supported from the longitudinal members 34, see FIG. 1. If it is desired, the connection between the hydraulic cylinder 58 and the lever 46 as at 62 may be released and the cylinder 58 may be removably anchored to the end of the thrust member 84 remote from the frame 80 in order to operably connect the frame 80 to the cylinder 58 in lieu of the lever 46.

In operation, and assuming the cylinder 58 is operably connected to the lever 46 as shown in FIG. 2, the valves 72 and 74 may be adjusted as desired and a person either seated upon the cushion construction 26 and facing the standard 18 or lying upon the cushion construction 26 may engage the opposite ends of the bar 56 with his hands and exercise his arms and upper torso by pushing the hand grip end of the lever 46 up and down. Obviously, the height of the assembly comprising the lever 46 and the cylinder 58 may be adjusted relative to the standard 18. Further, the angulation of the cylinder 58 relative to the lever 46 may be adjusted while maintaining the hand grip bar 56 at the same elevation. This will enable different muscles to be exercised and the lever 46 to have a different lever mechanical advantage on the cylinder 58 at opposite ends of the exercising stroke of the user. Also, the assembly comprising the lever 46 and cylinder 58 may be inverted relative to the standard 18 and the space between the arms 54 may be used to receive the head and neck portions of the user (when seated) through the free swinging end of the lever 46.

Further, inasmuch as the lower end of the standard 18 is rigid with the base 12, the inclination of the bench 20 may be adjusted by utilizing the removable pins 42 and the pivot connection between the legs 36 and the bench 20 and base 12 enables the inclination of the bench 20 to be adjusted independent of any specific adjustment of the end of the bench 20 remove from the standard 18.

After having exercised the arms and the upper torso, the cylinder 58 may be disconnected from the lever 46 and removably connected to the end of the thrust member 84 remote from the frame 20. Thereafter, the user of the exercise machine 10 may exercise his legs.

Of course, the valves 72 and 74 may be similarly adjusted or dissimilarly adjusted as desired and the overall adjustability of the exercise machine 10 offers a considerable range of exercises which may be carried out with a relatively simple exercising apparatus.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An exercise machine including an elongated base having first and second ends, upright standard means stationarily mounted from said first end, horizontally elongated bench means including first and second ends, extending longitudinally of and spaced above said base, upstanding leg means including upper and lower ends pivotally mounted to said second end of said bench means and base, respectively, said first end of said bench means and said standard means including first co-acting pivot means operative to releasably pivotally anchor said first end of said bench means to a mid-height portion of said standard in selected adjusted elevated positions thereon, an elongated generally horizontal lever, said standard and one end of said lever including second co-acting pivot means pivotally mounting said one lever end from said standard above said first co-acting pivot means for oscillation about a first horizontal axis extending transversely of said standard and said lever and adjusted shifting of said axis along said standard, resistance means connected between said lever and said standard operative to yieldingly resist angular displacement of said lever about said axis, said resistance means including an elongated resistance mechanism having telescopically engaged opposite ends and means operative to variably resist telescopic extension and retraction of said opposite ends, means pivotally connecting one end of said resistance mechanism to said lever and third co-acting pivot means pivotally mounting the other end of said resistance mechanism from said standard for angular displacement about a second horizontal axis spaced relative to said first axis, a leg exercising frame oscillatably supported from the second end of said bench means and including a depending portion, an elongated thrust member disposed beneath and extending longitudinally of said bench means and having one end pivotally supported from the lower end of said depending portion, said means pivotally connecting one end of said resistance mechanism to said lever comprising removable connecting means also operative to removably connect said one end of said resistance mechanism to the other end of said thrust member with said thrust member and resistance mechanism joined together in substantial longitudinally aligned positions.

2. The exercise machine of claim 1 wherein said second and third co-acting pivot means releasably mount said lever and said other end of said resistance mechanism from said standard, said second and third co-acting pivot means including means operative to mount said lever and said other resistance mechanism end from said standard in reverse elevated positions thereon.

3. A hydraulic exercise machine including a stationary mount, said stationary mount including a horizontally elongated base having first and second ends and upright standard means stationarily mounted from said first end, horizontally elongated bench means including first and second ends extending longitudinally of and spaced above said base, upstanding leg means including upper and lower ends pivotally mounted to said second end of said bench means and base, respectively, said first end of said bench means and said standard means including first co-acting pivot means operative to releasably anchor said first end of said bench means to a mid-height portion of said standard in elected adjusted elevated positions thereon, said standard means including horizontally spaced apart uprights spaced transversely of said base, elongated lever means having one end oscillatably supported from said mount, an elongated extendable and retractable double acting hydraulic cylinder, first and second means pivotally connecting first and second ends of said hydraulic cylinder to the other end of said lever and said mount, respectively, a hydraulic fluid reservoir tank including fluid inlet and outlet means, said hydraulic cylinder including opposite end fluid inlet and outlet means, and separate hydraulic fluid lines including one pair of corresponding ends sealingly communicated with said hydraulic cylinder fluid inlet and outlet means and a second set of ends in sealed communication with said hydraulic fluid tank inlet and outlet means and including variable fluid flow throttling valve means serially connected therein, said hydraulic fluid reservoir tank extending between and interconnecting the upper ends of said uprights, said bench means including an elongated cushion construction extending longitudinally thereof, said first end of said bench means including laterally spaced longitudinal frame members projecting outwardly of the corresponding end of said bench cushion with whose outer ends said first co-acting pivot means is operatively associated, the spacing between said longitudinal frame members being sufficient to receive said hydraulic cylinder therebetween outward of the adjacent end of said cushion construction.

4. The hydraulic exercise machine of claim 3 wherein said hydraulic fluid tank inlet and outlet means includes a pair of fluid inlet and outlet fittings opening into said tank, said second set of ends being in sealing communication with said pair of inlet and outlet fittings.

* * * * *